US008663005B2

(12) United States Patent
Anderson et al.

(10) Patent No.: US 8,663,005 B2
(45) Date of Patent: Mar. 4, 2014

(54) DYNAMIC SKINNING OF WAGERING GAMES

(75) Inventors: Peter R. Anderson, Glenview, IL (US); Robby M. Friedman, Round Lake, IL (US); Michael J. Irby, II, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 203 days.

(21) Appl. No.: 13/128,655

(22) PCT Filed: Nov. 13, 2009

(86) PCT No.: PCT/US2009/064480

§ 371 (c)(1),
(2), (4) Date: May 11, 2011

(87) PCT Pub. No.: WO2010/057056

PCT Pub. Date: May 20, 2010

(65) Prior Publication Data

US 2011/0218042 A1 Sep. 8, 2011

Related U.S. Application Data

(60) Provisional application No. 61/114,516, filed on Nov. 14, 2008.

(51) Int. Cl.
*A63F 9/24* (2006.01)

(52) U.S. Cl.
USPC ..... 463/31

(58) Field of Classification Search
USPC ..... 463/31
See application file for complete search history.

(56) References Cited

U.S. PATENT DOCUMENTS

| | | | | |
|---|---|---|---|---|
| 7,099,946 | B2 | 8/2006 | Lennon et al. | |
| 7,392,470 | B2 * | 6/2008 | Kammler | 715/234 |
| 2002/0107973 | A1 | 8/2002 | Lennon et al. | |
| 2002/0151366 | A1 * | 10/2002 | Walker et al. | 463/42 |
| 2003/0069074 | A1 | 4/2003 | Jackson | |
| 2005/0192092 | A1 * | 9/2005 | Breckner et al. | 463/31 |
| 2006/0287054 | A1 | 12/2006 | Walker et al. | |
| 2010/0016075 | A1 * | 1/2010 | Thomas | 463/30 |

FOREIGN PATENT DOCUMENTS

WO WO2010057056 5/2010

OTHER PUBLICATIONS

"PCT Application No. PCT/US09/64480 International Preliminary Report on Patentability", Apr. 4, 2011 , 13 pages.
"PCT Application No. PCT/US09/64480 International Search Report", Jan. 20, 2010 , 8 pages.

* cited by examiner

*Primary Examiner* — Corbett B Coburn
(74) *Attorney, Agent, or Firm* — DeLizio Gilliam, PLLC

(57) ABSTRACT

An editing tool generates a progressive game skin and code for instantiating the progressive game skin. The progressive skin indicates various perceivable elements (e.g., visual elements, aural elements, etc.) and skin configurations (e.g., layout for perceivable elements, timing for presenting perceivable elements, properties of perceivable elements, etc.). The progressive skin may also indicate target presentation devices for presenting the perceivable elements indicated by the progressive skin. The progressive skin editing tool provides the progressive skin to a device that controls one or more devices that will present the perceivable element indicated by the progressive skin. The controlling device ("media controller") reads the progressive skin and causes the one or more devices to present the indicated perceivable elements as indicated by the progressive skin ("instantiates the progressive skin").

23 Claims, 9 Drawing Sheets

DYNAMIC SKINNING OF WAGERING GAMES

RELATED APPLICATIONS

This application claims the priority benefit of U.S. Provisional Application Ser. No. 61/114,516 filed Nov. 14, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to dynamically modifying skins of wagering games.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method comprises indicating a plurality of perceivable elements for a presentation template of a progressive game; modifying the presentation template in accordance with a set of one or more configurations that at least comprise spatial layout of one or more of the plurality of perceivable elements; and generating code for instantiating the presentation template on a set of one or more devices in accordance with the set of one or more configurations.

In some embodiments, the perceivable elements comprise at one or more of audio, video, an image, font, an animation sequence, and text.

In some embodiments, said indicating the plurality of perceivable elements comprises one or more of literal embedding and referential embedding.

In some embodiments, the set of one or more configurations also comprises one or more of a property of one or more of the perceivable elements, a condition for presentation of one or more of the perceivable elements, and timing for presentation of one or more of the perceivable elements.

In some embodiments, the code comprises one or more of executable code and interpreted code.

In some embodiments, the method further comprises providing the generated code and the presentation template to a controller device that controls the set of one or more devices for the controller device to execute or interpret the code.

In some embodiments, the method further comprises modifying the presentation template in accordance with specifications of the set of one or more devices.

In some embodiments, the method further comprises generating different versions of the presentation template to accommodate different specifications of different ones of the set of one or more devices.

In some embodiments, the method further comprises validating the set of one or more configurations prior to modifying the presentation template.

In some embodiments, instantiating the presentation template on the set of one or more devices comprises presenting the plurality of perceivable elements in accordance with the set of one or more configurations on the set of one or more devices.

In some embodiments, a progressive game skin editor comprises a presentation template generator operable to process configuration input and a plurality of indications of perceivable elements to generate a presentation template for dynamic skinning of progressive game instances; an instantiation code generator coupled with the presentation template generator, the instantiation code generator operable to examine the presentation template generated by the presentation template generator and to generate code which, when executed by a processor unit, instantiates the presentation template; and a preview unit coupled with the presentation template generator and the instantiation code generator, the preview unit operable to generate a preview instance of the presentation template with the instantiation code generated by the instantiation code generator.

In some embodiments, the preview unit being operable to generate a preview instance of the presentation template comprises the preview unit being operable to present the perceivable elements in accordance with the configuration input and the instantiation code on a device hosting the progressive game skin editor, wherein the configuration input comprises a layout configuration for the perceivable elements.

In some embodiments, the progressive game skin editor further comprises an interface unit operable to provide a graphical user interface for receiving the configuration input and the plurality of indications of perceivable elements, and operable to provide the configuration input and the plurality of indications of perceivable elements to the presentation template generator.

In some embodiments, a computer program product comprises instructions encoded in one or more machine-readable media, wherein the instructions, when executed by a set of one or more processors, cause the set of one or more processors to perform operations that comprise indicating a plurality of perceivable elements for a presentation template of a progressive game; modifying the presentation template in accordance with a set of one or more configurations that at least comprise spatial layout of one or more of the plurality of perceivable elements; and generating code for instantiating the presentation template on a set of one or more devices in accordance with the set of one or more configurations.

In some embodiments, said operation of indicating the plurality of perceivable elements comprises one or more of literal embedding and referential embedding.

In some embodiments, the set of one or more configurations also comprises one or more of a property of one or more of the perceivable elements, a condition for presentation of one or more of the perceivable elements, and timing for presentation of one or more of the perceivable elements.

In some embodiments, the operations further comprise providing the generated code and the presentation template to a controller device that controls the set of one or more devices for the controller device to execute or interpret the code.

In some embodiments, instantiating the presentation template on the set of one or more devices comprises presenting the plurality of perceivable elements in accordance with the set of one or more configurations on the set of one or more devices.

In some embodiments, an apparatus comprises a set of one or more processor units; a network interface; and means for dynamically modifying presentation of a progressive wagering game as presented by one or more devices based, at least in part, on a progressive game skin and code for instantiating the progressive game skin.

In some embodiments, the apparatus further comprises means for at least one of interpreting the code and executing the code.

In some embodiments, the apparatus further comprises means for obtaining a set of one or more perceivable elements indicated by the progressive game skin, wherein the set of one or more perceivable elements comprises one or more of a video, audio, an animation sequence, an image, font, and text.

In some embodiments, an apparatus comprises a set of one or more processor units; a network interface; and a progressive game skin editor operable to, indicate a plurality of perceivable elements for a presentation template of a progressive game; modify the presentation template in accordance with a set of one or more configurations that at least comprise spatial layout of one or more of the plurality of perceivable elements; and generate code for instantiating the presentation template on a set of one or more devices in accordance with the set of one or more configurations.

In some embodiments, the progressive game skin editor is further operable to modify the presentation template in accordance with specifications of the set of one or more devices.

In some embodiments, the progressive game skin editor is further operable to generate different versions of the presentation template for compatibility with different specifications of different ones of the set of one or more devices.

In some embodiments, instantiating the presentation template on the set of one or more devices comprises presenting the plurality of perceivable elements in accordance with the set of one or more configurations on the set of one or more devices.

In some embodiments, the progressive game skin editor is further operable to determine status of a progressive game skin deployed on a second set of one or more devices, and operable to configure individual ones of the second set of one or more devices.

In some embodiments, a method comprises in response to determining that a first skin of a first game instance is to change, updating the first skin with a set of perceivable elements; determining that a second game instance is associated with the first game instance; indicating the set of perceivable elements to the second game instance; and updating a second skin of the second game instance with the set of perceivable elements.

In some embodiments, at least one of the first game instance and the second game instance comprises a portal game instance.

In some embodiments, said updating the first skin with the set of perceivable elements comprises determining elements of a presentation template that will change, wherein the presentation template corresponds to the first skin; loading the set of perceivable elements into the presentation template; and instantiating the presentation template with the set of perceivable elements.

In some embodiments, said indicating the set of perceivable elements to the second game instance comprises invoking hook code with indications of the set of perceivable elements, wherein the hook code is invoked from the first game instance and the hook code is associated with the second game instance.

BRIEF DESCRIPTION OF THE FIGURES

Embodiments of the invention are illustrated in the Figures of the accompanying drawings in which.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. For instance, examples refer to a progressive skin editor and a media controller as disparate. Embodiments can implement the functionality for editing and dynamic deployment of progressive skins and the functionality for controlling devices to present the skins in a single machine, as a single application, over a distributed system, etc. In other instances, well-known instruction instances, protocols, structures and techniques have not been shown in detail in order not to obfuscate the description.

Presentation of progressive games can be enhanced by updating elements of the presentation (e.g., visual elements, aural elements, etc.), thus increasing interest/attraction. A wagering game establishment or wagering game developer can update the elements with a popular television show theme, a popular character, a movie promotion, etc. The wagering game establishment and/or wagering game developer can also update the elements to track seasonal elements (e.g., holiday themes, election themes, etc.). An editing tool can efficiently create or modify a configurable presentation template for presenting perceivable elements for a progressive game ("progressive game skin") and dynamically deploy the progressive game skin ("dynamically skinning"). The editing tool generates a progressive game skin and code for instantiating the progressive game skin. The progressive skin indicates various perceivable elements (e.g., visual elements, aural elements, etc.) and skin configurations (e.g., layout for perceivable elements, timing for presenting perceivable elements, properties of perceivable elements, etc.). The progressive skin may also indicate target presentation devices for presenting the perceivable elements indicated by the progressive skin. The progressive skin editing tool provides the progressive skin to a device that controls one or more devices that will present the perceivable element indicated by the progressive skin. The controlling device ("media controller") reads the progressive skin and causes the one or more devices to present the indicated perceivable elements as indicated by the progressive skin ("instantiates the progressive skin").

Figure 1:
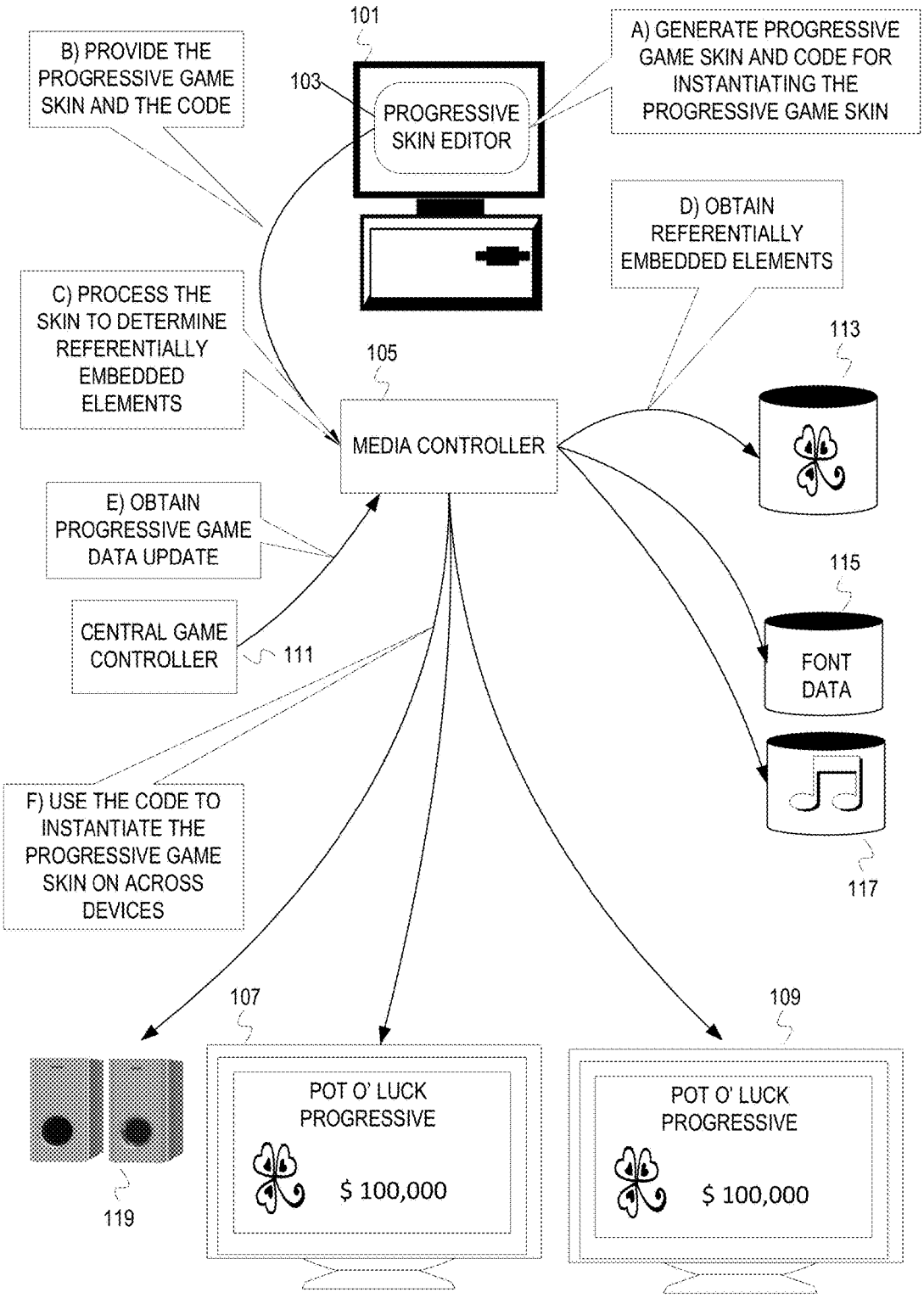
FIG. 1 depicts a conceptual diagram of dynamic skinning of a progressive game.

FIG. 1 depicts a conceptual diagram of dynamic skinning of a progressive game. In FIG. 1, a computer 101 hosts a progressive skin editor 103. At a stage A, the progressive skin editor 103 generates a progressive game skin and code for instantiating the progressive game skin. For example, the progressive skin editor 103 generates a progressive game skin based on indications of a clover image, a font type for a jackpot meter, audio, and a title for the progressive wagering game. The progressive skin indicates layout of the jackpot meter, clover, and title. The progressive skin also indicates conditions for playing the indicated audio.

At a stage B, the progressive skin editor 103 provides the progressive game skin and instantiation code to a media controller 105. The media controller 105 controls electronic signs 107, 109 and an audio system 119. Examples of the progressive skin editor 103 providing the progressive game skin and the instantiation code to the media controller 105 include transmitting the progressive game skin and the code to the media controller 105, transmitting a message that indicates a location of the progressive game skin and the code, etc.

At a stage C, the media controller 105 processes the progressive game skin to determine referentially embedded perceivable elements. In this example, the clover image, font data, and the audio have been referentially indicated or embedded in the progressive game skin (e.g., network paths to the elements are indicated).

At a stage D, the media controller 105 obtains the clover image from a remote store 113, the font data from a remote store 115, and the audio from a remote store 117. The remote stores may be network drives, flash memory, stores on server within a network of the media controller 105, stores accessible via the Internet, etc.

At a stage E, the media controller obtains a progressive game data update from a central game controller 111 (e.g., current progressive jackpot amounts). The media controller 105 may have previously requested the data, may have previously received the data, may receive an update whenever a change occurs, may have a live feed of updates, etc.

At a stage F, the media controller 105 uses the instantiation code to instantiate the progressive game skin on the audio system 119 and the signs 107, 109. The media controller 105 interprets and/or executes the code. The code causes the media controller 105 to provide the perceivable elements for presentation to the audio system 119, and the signs 107, 109 in accordance with the progressive game skin. In this example, the media controller 105 causes the signs s107, 109 to display the title of the progressive game as "POT O' Luck Progressive" in a font type and size indicated by the progressive game skin. Similarly, the media controller causes the signs 107, 109 to display the current amount of the largest of the progressive jackpots in a font size, font type, color, etc. indicated by the progressive game skin. The media controller 105 also causes the audio system 119 to play different music files when corresponding conditions (indicated by the progressive game skin) are met. For instance, a first music file is played when the jackpot amount exceeds $200,000.

It should be realized from the example depicted by FIG. 1 that a variety of skinning scenarios are possible with dynamic skinning. For example, a progressive game skin can guide a media controller to coordinate audio, lighting, and displays for a Christmas holiday theme until midnight of December $25^{th}$, and dynamically switch to a New Year's theme. The progressive game skins can be pushed concurrently to multiple presentation devices, in an orchestrated order, serially, etc. As another example, a progressive game skin can be switched from licensed elements upon expiration of a license for those elements to newly licensed elements. Furthermore, instantiating a progressive game skin can involve activating mechanical devices, sending communications (e.g., sending text messages), activating lights, rotating visual elements over multiple displays, and playing different audio on different audio systems in a coordinated manner.

Figure 2:
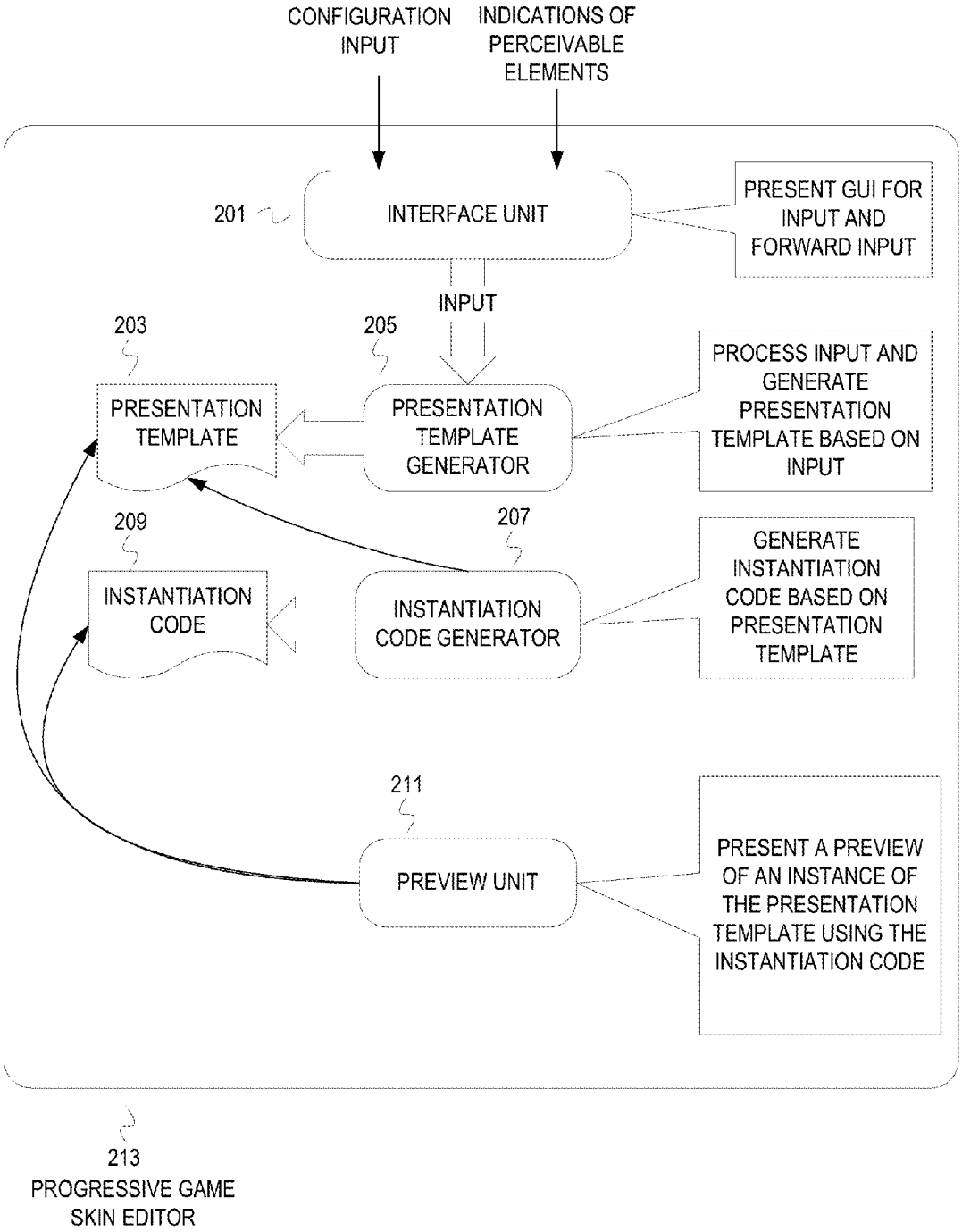
FIG. 2 depicts a conceptual diagram of an example progressive game skin editor.

FIG. 2 depicts a conceptual diagram of an example progressive game skin editor. A progressive game skin editor 213 comprises an interface unit 201, a presentation template generator 205, an instantiation code generator 207, and a preview unit 211.

The interface unit 201 provides a graphical user interface to receive configuration input and indications of perceivable elements. Examples of configuration input include properties of perceivable elements, layout of visual elements, presentation device identifiers, presentation device specifications, and presentation conditions. Examples of perceivable elements include audio, video, an image, an animation sequence, font, and text. Examples of the indications of perceivable elements include file names, paths to the elements, etc. The interface unit 201 passes the input to the presentation template generator 205.

The presentation template generator 205 processes the input and generates a presentation template 203 based on the input. The presentation template generator 205 may also factor in administrator settings, global configurations, etc.

The instantiation code generator 207 generates instantiation code 209 based on the presentation template 203. Examples of the instantiation code 209 include interpreted code, executable code, object code, etc. Additional input that can affect generation of the instantiation code 209 include configuration input, such as presentation device specifications.

The preview unit 211 presents a preview instance of the presentation template 203 using the instantiation code 209. For instance, the preview unit 211 interprets the instantiation code 209 to instantiate the presentation template 203 on a device hosing the progressive game skin editor 213. The preview unit 211 may make adjustments to accommodate specifications of the device hosting the progressive game skin editor 213 (e.g., smaller screen, lower resolution, etc.).

A progressive game skin editor is not limited to the example depicted in FIG. 2. Embodiments can implement additional functionality in a progressive game skin editor. For instance, a progressive game skin editor can be implemented with a configuration unit. The configuration unit can determine status of deployed progressive game skins. For example, the configuration unit can maintain a structure that tracks what progressive game skins have been deployed and where. As another example, the configuration unit can query media controllers and/or presentation devices to determine status of progressive game skins. The configuration unit can provide data for the interface unit to display state of the progressive game skins with thumbnails, text, snapshots, etc. The configuration unit can also establish a direct communication or communicate via a media controller to configure individual devices or subsets of devices. A user can tweak configurations of individual devices to customize or correct presentation of a progressive game skin.

Figure 3:
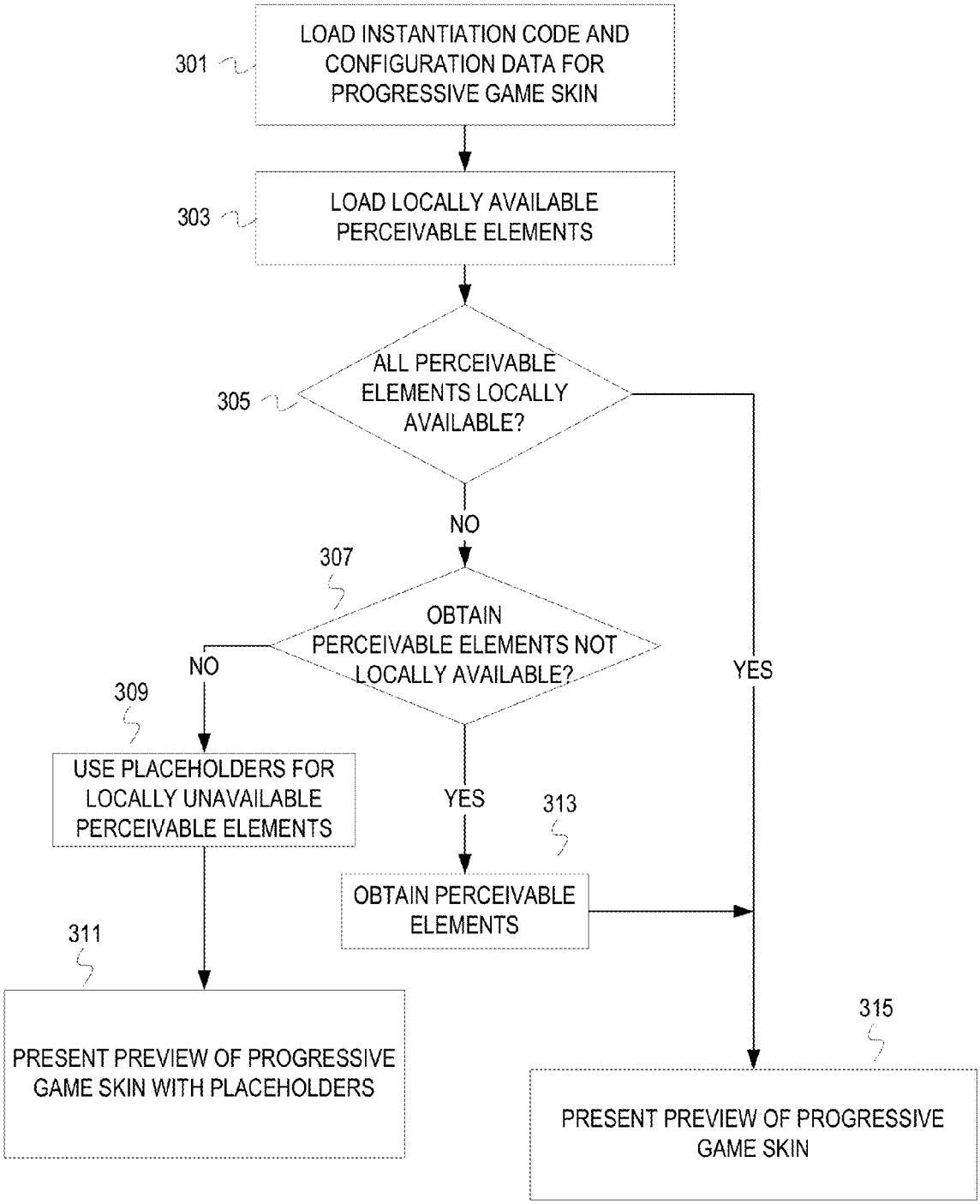
FIG. 3 depicts a flowchart of example operations for previewing a progressive game skin.

FIG. 3 depicts a flowchart of example operations for previewing a progressive game skin. At block 301, instantiation code and configuration data of a progressive game skin are loaded.

At block 303, locally available perceivable elements indicated by the progressive game skin are loaded. For example, elements on a local drive are loaded.

At block 305, it is determined if all perceivable elements are locally available. For example, a progressive game skin editor determines if any perceivable elements are indicated with paths that include network addresses. If all of the perceivable elements are locally available, then control flows to block 315. Otherwise, control flows to block 307.

At block 307, it is determined if the perceivable elements that are not locally available can be obtained. If so, then control flows to block 313. If the perceivable elements that are not locally available cannot or should not be obtained, then control flows to block 309. For example, some perceivable elements may be suspicious, not licensed yet, require approval to access sites beyond a firewall, etc.

At block 313, the perceivable elements that were not locally available are obtained. For example, perceivable elements are obtained from online communities, stores that require authorization, from an external developer site, etc. Control flows from block 313 to block 315.

At block 315, a preview of the progressive game skin is presented.

At block 309, placeholders are used for the locally unavailable perceived elements and elements that have not been obtained. Examples of placeholders include mock images, default content, similar content, etc. that occupy a space or play at a time of an unavailable element.

At block 311, a preview of the progressive game skin is presented with the placeholders.

Figure 4:
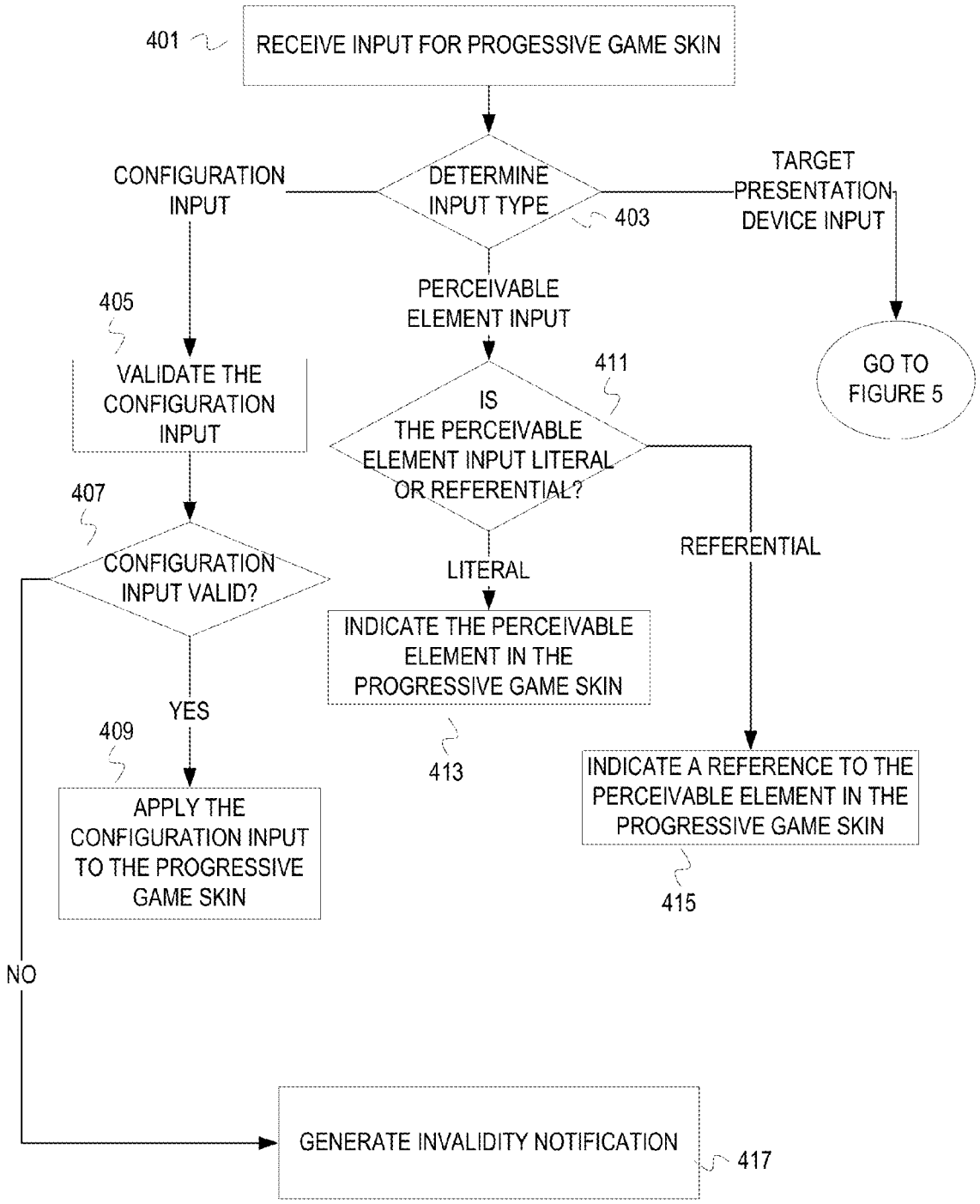
FIG. 4 depicts a flowchart of example operations for processing input into a progressive game skin editor.

FIG. 4 depicts a flowchart of example operations for processing input into a progressive game skin editor. At block 401, input for a progressive game skin is received.

Figure 5:
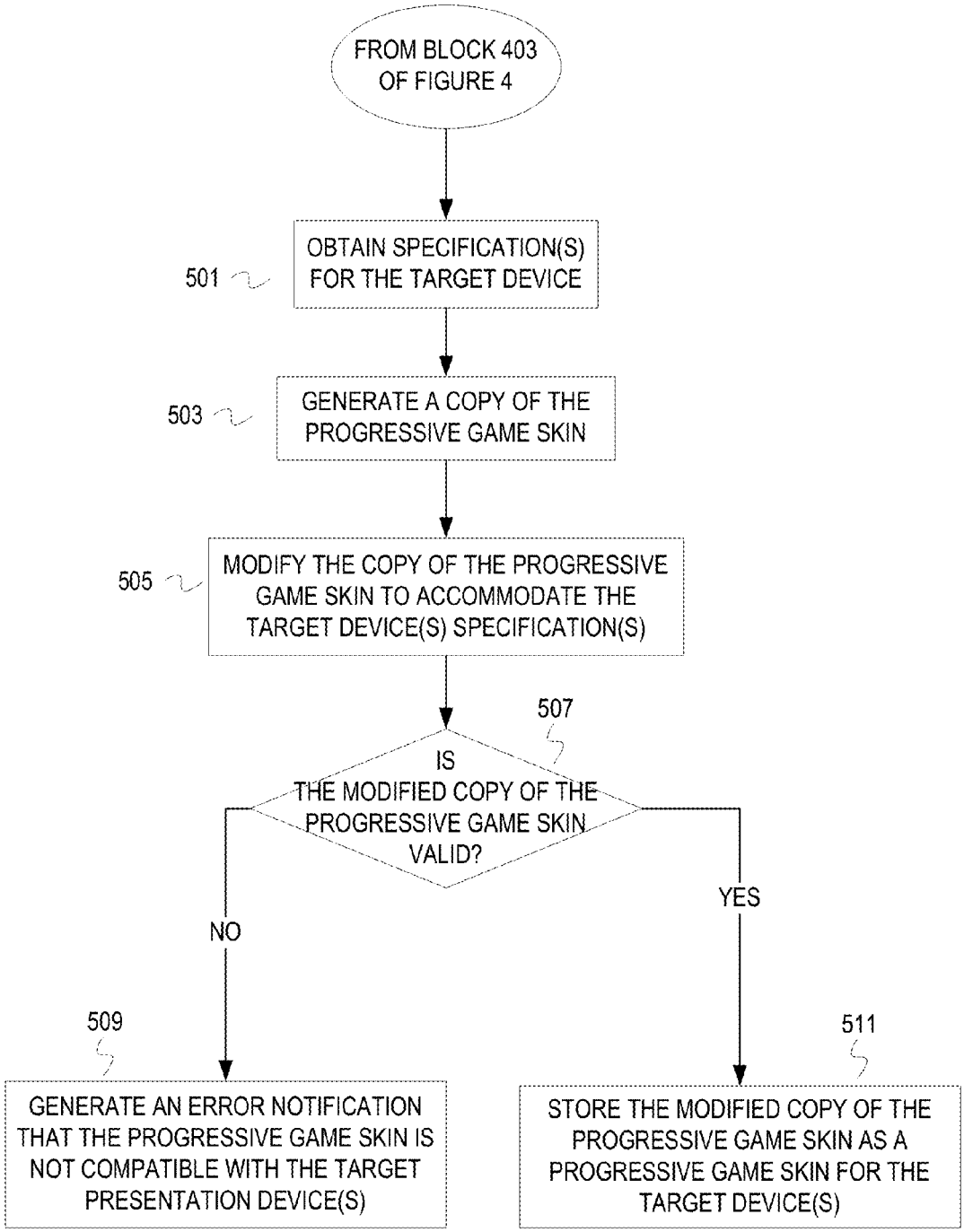
FIG. 5 continues from FIG. 4 and depicts a flowchart of example operations for processing target presentation device input.

At block 403, the type of input is determined. If the input is configuration input, then control flows to block 405. If the input is perceivable element input, then control flows to block 411. If the input is target presentation device input, then control flows to FIG. 5.

At block 405, the configuration input is validated. For example, the configuration input is evaluated against conditional in light of current configurations (e.g., size of a frame violates frame size restrictions or intrudes into space occupied by an element).

At block 407, it is determined if the configuration input is valid. If the configuration input is valid, then control flows to block 409. If the configuration input is not valid, then control flows to block 417.

At block 409, the configuration input is applied to the progressive game skin. For instance, configuration data is stored in a structure that represents the progressive game skin and properties of elements are set.

At block 417, an invalidity notification is generated. The notification can inform the user of the particular violating configuration and cause.

If the input was determined to be perceivable element input at block 403, then it is determined if the perceivable element input is literal or referential. For example, the input is exampled to determine if it is a path or graphical data. If the perceivable element input references a perceivable element, then control flows to block 415. If the perceivable element input comprises literal perceivable element data, then control flows to block 413.

At block 415, a reference to the perceivable element is indicated in the progressive game skin. For example, a network path is embedded.

At block 413, the perceivable element is indicated in the progressive game skin. For example, the literal data is embedded, FIG. 5 continues from FIG. 4 and depicts a flowchart of example operations for processing target presentation device input. At block 501, a specification(s) for a target presentation device(s) is obtained. For example, a library of specifications is accessed based on a model number of a presentation device.

At block 503, a copy of the progressive game skin is generated.

At block 505, the copy of the progressive game skin is modified to accommodate the target presentation device(s) specification(s). For example, the progressive game skin is modified to accommodate a maximum resolution and sound encoding of a presentation device.

At block 507, it is determined if the modified copy of the progressive game skin is valid. For example, it is determined if constraints defined for the progressive game skin or defined by the editor are satisfied by the modified copy of the progressive game skin. In another example, a user indicates whether a preview of the modified copy of the progressive game skin is acceptable. If the modified copy of the progressive game skin is not valid, then control flows to block 509. If the modified copy of the progressive game skin is valid, then control flows to block 511.

At block 509, an error notification is generated. The error notification indicates that the progressive game skin is not compatible with the target presentation device(s). The notification can also indicate particular incompatibilities with reference to the specification(s).

At block 511, the modified copy of the progressive game skin is stored as a progressive game skin for the target presentation device(s). Embodiments can also embed data representative of the modifications and indicating the target presentation device(s) in the original progressive game skin. Hence, a single progressive game skin can carry information to instantiate the progressive game skin on a variety of presentation devices.

Figure 6:
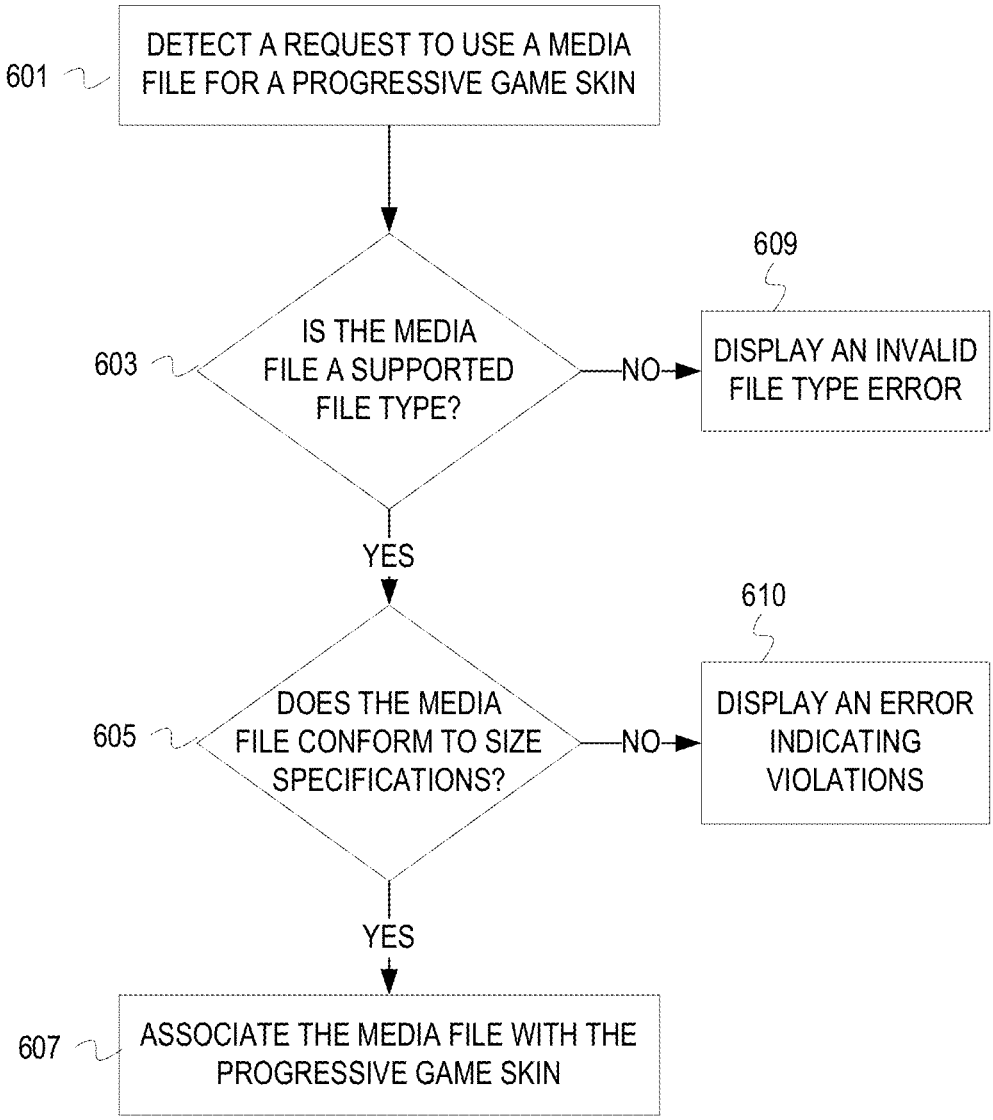
FIG. 6 depicts a flowchart of example operations for validating a media file type.

A variety of additional checks can be performed when editing a progressing game skin. FIG. 6 depicts a flowchart of example operations for validating a media file type. At block 601, a request to use a media file for a progressive game skin is detected.

At block 603 it is determined if the media file is of a supported file type. If the media file is not of a supported type, then control flows to block 609. If the file type is supported, then control flows to block 605.

At block 609, an invalid file type error is displayed.

If the media file is of a supported type, then it is determined if the media file conforms to size specifications of the progressive game skin at block 605. If the media file does not conform to size specifications, then control flows to block 610. If the media file conforms to the size specifications, then control flows to block 607.

At block 607, the media file is associated with the progressive game skin.

If it was determined that the media file did not conform to size specifications at block 605, then an error indicating violation of the size specification is displayed.

It should be understood that the depicted flowcharts are examples meant to aid in understanding embodiments and should not be used to limit embodiments or limit scope of the claims. Embodiments may perform additional operations, fewer operations, operations in a different order, operations in parallel, and some operations differently. For instance, referring to FIG. 3, additional operation can be performed for each indicated perceivable element to determine whether the element can be obtained or whether a substitute can be obtained. Additional operations can also be performed to preview a progressive game instance with perceivable elements that cannot be presented by the device hosting the progressive game skin editor (e.g., an animated sequence representing lighting). With reference to FIG. 6, additional operations can be performed to resolve an unsupported file type (e.g., downloading drivers, converting the file, etc.).

Additional operations can also be performed to apply dynamic skinning in a portal environment. A base game and a portal game (e.g., a mystery progressive game, a side game, secondary game, supplemental game, etc.) can be unidirectionally or bidirectionally "hooked" into each other to utilize perceivable elements of the other. For instance, a first set of dynamic perceivable elements are defined for a base game and a second set of dynamic perceivable elements are defined for a portal game. These sets of dynamic perceivable elements can change based on various conditions, factors, variables, and/or criteria (e.g., changing season, changing licenses, etc.). The base game can hook into the second set of perceivable elements while the portal game can hook into the first set of perceivable elements. Thus, the base game can rely on the second game (or code or configurations associated with the second game) for dynamic skinning that varies with the portal game while the portal game can rely on the base game (or code or configurations associated with the base game) for dynamic skinning that varies with the base game. Furthermore, a perceivable element can traverse a base game and a portal game.

Figure 9:
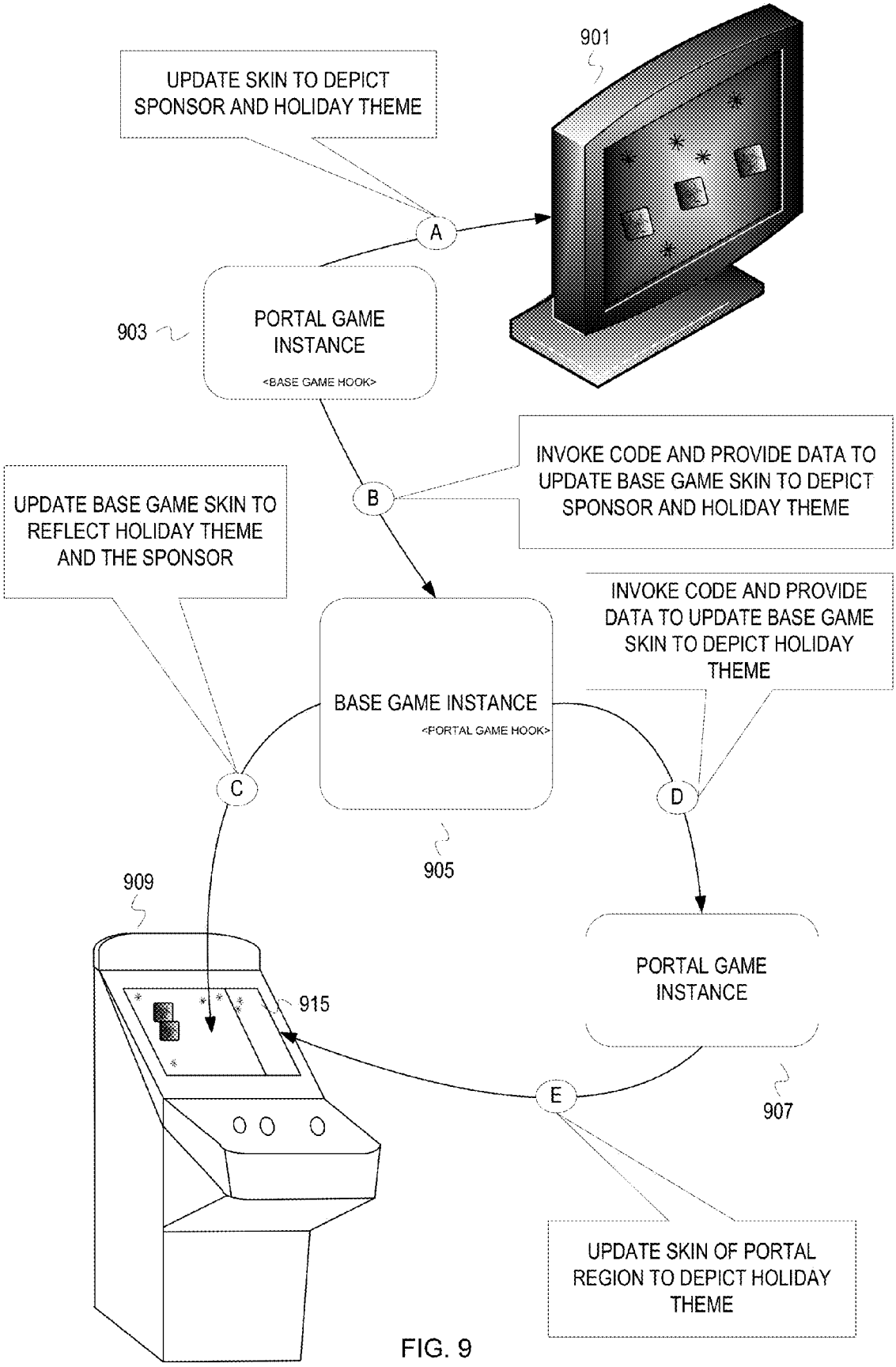
FIG. 9 depicts a conceptual diagram of dynamic skinning in a portal game scenario.

FIG. 9 depicts a conceptual diagram of dynamic skinning in a portal game scenario. In FIG. 9, a base game instance 905 has been hooked into a portal game instance 903, and a portal game instance 907 has been hooked into the base game instance 905. The portal game instance 903 is associated with a display device 901. The base game instance 905 is associated with a display of a wagering game machine 909. The portal game instance 907 is associated with a portion of the display 915 ("portal region") of the wagering game machine 909.

At a stage A, the portal game instance 903 updates corresponding skin to depict a sponsor and a holiday theme on the display 901. For example, in response to a new sponsor (e.g., sponsorship can revolve), the portal game instance can update tiles with a graphic licensed from the sponsor for display on the display 901. In addition, the portal game instance can update the background in accordance with a particular holiday and run code for an animation of a holiday figure.

At stage B, the portal game instance invokes code and provides data for updating skin of the base game instance 905 to depict the sponsor and the holiday theme. To continue the above example, the portal game instance 903 can pass referential or literal elements for the licensed symbol of the sponsor and elements of the holiday background to the base game instance 905. The hook into the portal game instance or code that control skinning can determine that all dynamic skinning elements of the portal game instance 903 are inherited by the base game instance 905, or that at least the portal game instance elements influence the base game instance 905.

At stage C, the base game instance 905 updates the base game skin to reflect the holiday theme and the sponsor. In this case, the base game instance 905 causes the display of the wagering game instance 909 to display tiles with the licensed graphics and the background in accordance with the holiday theme.

At stage D, the base game instance 905 invokes code and provides data for updating skin corresponding to the portal game instance 907. The invoked code and data allows for the portal game instance to depict the holiday theme. In this case, the portal game hook in the base game instance 905 (or dynamic skinning instantiation code) determines that the portal game instance 907 cannot have access or cannot display elements licensed by the sponsor.

At stage E, the portal game instance 907 updates skin of the portal region 915. The portal game instance 907 can update the skin of the portal region to be continuous or distinct from the base game display region. For example, a background can be continued from the base game display region or be distinct. The game instances can use a sprite that interleaves graphical elements between the games ("shim sprite"). For example, a visual dynamic skinning element can be drawn across the base game and the portal game. As an example, holiday theme to be depicted can include an animated holiday figure. The portal game instance and the base game instance can utilize a shim sprite to depict the holiday figure as moving uninterrupted across the base game region and the portal game region 915. As another example, graphical elements to depict snowing can be drawn across the base and the portal game regions. A more detailed description of a shim sprite can be found in U.S. Pat. No. 8,357,039, entitled "CONFIGURING AND CONTROLLING WAGERING GAME COMPATIBILITY," and naming as inventors Peter R. Anderson, Michael J. Irby, and Craig J. Sylla, which is incorporated herein in its entirety.

Although the example illustrated in FIG. 9 refers to the game instances as performing various operations, dynamic skinning operations can be performed by other code/hardware. Embodiments can separate code that controls presentation of perceivable elements (e.g., code that draws graphics onto a display) from an instance of a game. Operations for dynamic skinning can be performed by code that handles presentation of perceivable elements separate from games instances, although the presentation code can be associated with game instances.

Embodiments may take the form of an entirely hardware embodiment, a software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM);

erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (for example, through the Internet using an Internet Service Provider).

Wagering Game Machine Architectures

Figure 7:
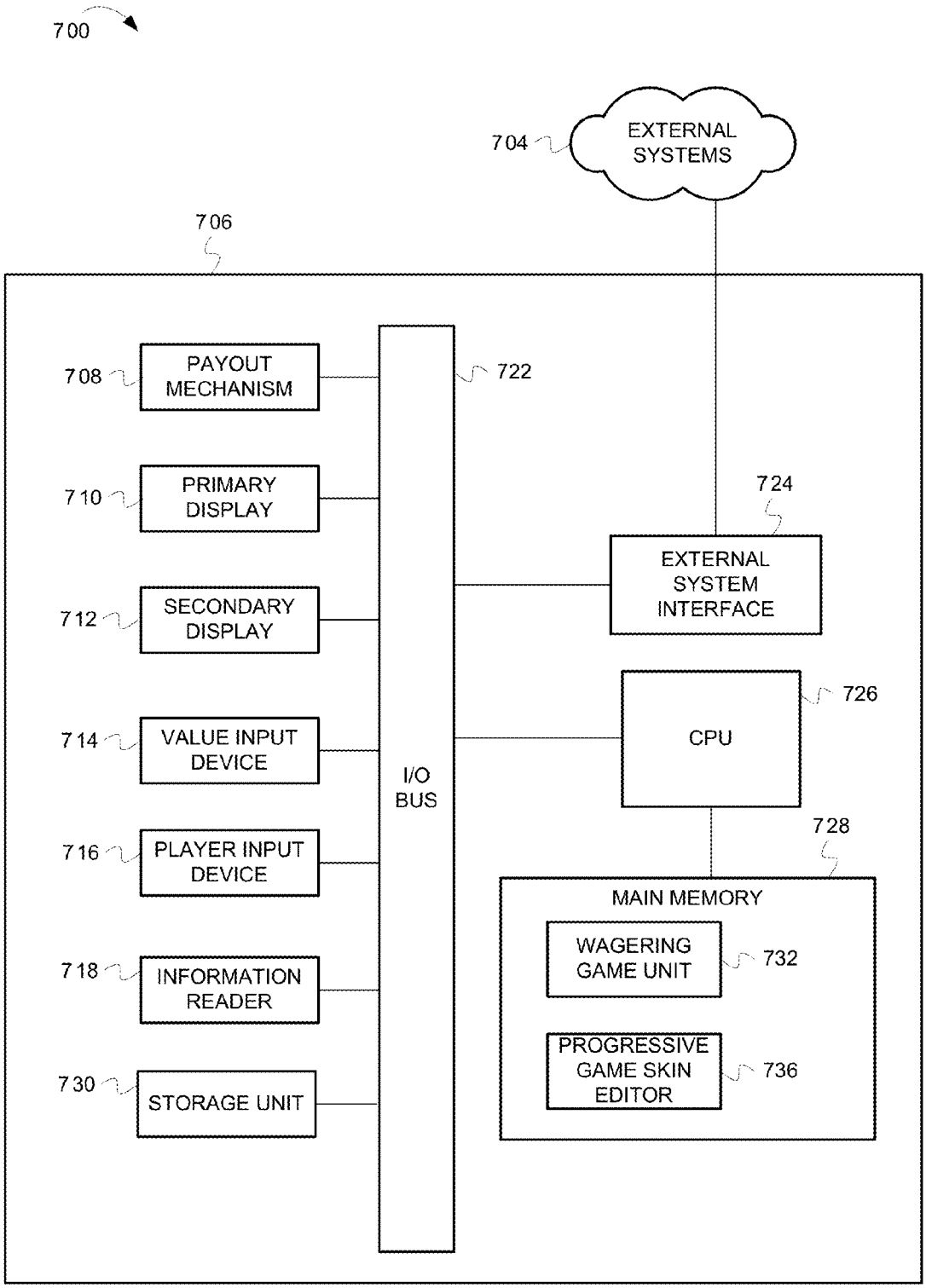
FIG. 7 is a block diagram illustrating a wagering game machine architecture, according to example embodiments of the invention.

FIG. 7 is a block diagram illustrating a wagering game machine architecture, according to example embodiments of the invention. As shown in FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732 and a progressive game skin editor. In one embodiment, the wagering game unit 732 can present wagering games, such as video poker, video black jack, video slots, video lottery, etc., in whole or part. The progressive game skin editor 736 allows editing of a progressive game skin and previewing of a progressive game skin. At the wagering game machine 700, a progressive game skin can be edited and then previewed with resources of the wagering game machine 700 or on one or more devices near and/or coupled with the wagering game machine 700. The progressive game skin editor 736 can also deploy a progressive game skin from the wagering game machine 700.

The CPU 726 is also connected to an input/output (I/O) bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks).

In one embodiment, the wagering game machine 706 can include additional peripheral devices and/or more than one of each component shown in FIG. 7. For example, in one embodiment, the wagering game machine 706 can include multiple external system interfaces 724 and/or multiple CPUs 726. In one embodiment, any of the components can be integrated or subdivided.

Any component of the architecture 700 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 7 describes an example wagering game machine architecture, this section continues with a discussion wagering game networks.

Wagering Game Networks

Figure 8:
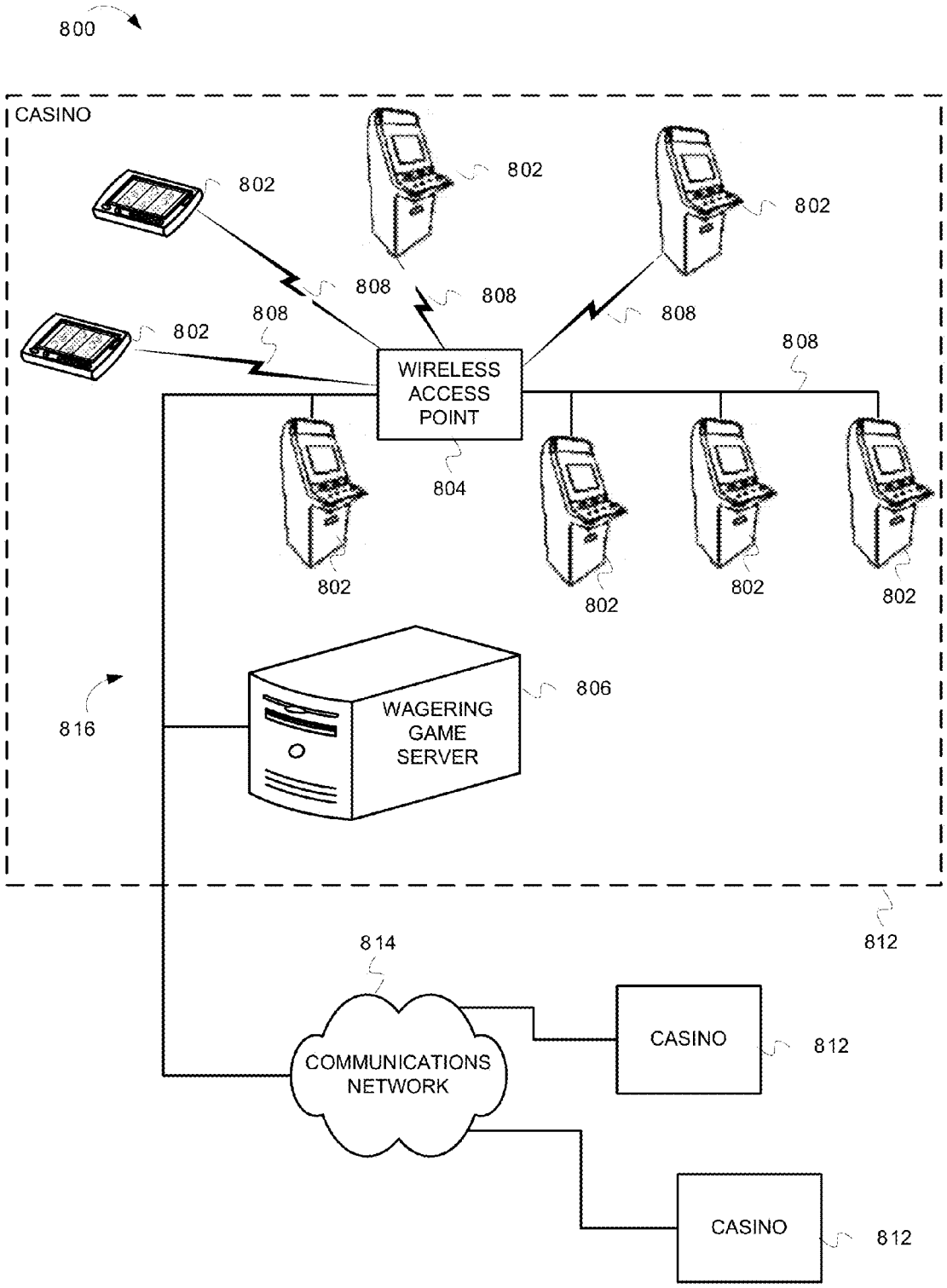
FIG. 8 is a block diagram illustrating a wagering game network 800, according to example embodiments of the invention.

FIG. 8 is a block diagram illustrating a wagering game network 800, according to example embodiments of the invention. As shown in FIG. 8, the wagering game network 800 includes a plurality of casinos 812 connected to a communications network 814.

Each casino 812 includes a local area network 816, which includes an access point 804, a wagering game server 806, and wagering game machines 802. The access point 8304 provides wireless communication links 810 and wired communication links 808. The wired and wireless communication links can employ any suitable connection technology, such as Bluetooth, 802.11, Ethernet, public switched telephone networks, SONET, etc. In some embodiments, the wagering game server 806 can serve wagering games and distribute content to devices located in other casinos 812 or at other locations on the communications network 814.

The wagering game machines 802 described herein can take any suitable form, such as floor standing models, handheld mobile units, bartop models, workstation-type console models, etc. Further, the wagering game machines 802 can be primarily dedicated for use in conducting wagering games, or can include non-dedicated devices, such as mobile phones, personal digital assistants, personal computers, etc. In one embodiment, the wagering game network 800 can include other network devices, such as accounting servers, wide area progressive servers, player tracking servers, and/or other devices suitable for use in connection with embodiments of the invention.

In some embodiments, wagering game machines 802 and wagering game servers 806 work together such that a wagering game machine 802 can be operated as a thin, thick, or intermediate client. For example, one or more elements of game play may be controlled by the wagering game machine 802 (client) or the wagering game server 806 (server). Game play elements can include executable game code, lookup tables, configuration files, game outcome, audio or visual representations of the game, game assets or the like. In a thin-client example, the wagering game server 806 can perform functions such as determining game outcome or managing assets, while the wagering game machine 802 can present a graphical representation of such outcome or asset modification to the user (e.g., player). In a thick-client example, the wagering game machines 802 can determine game outcomes and communicate the outcomes to the wagering game server 806 for recording or managing a player's account.

In some embodiments, either the wagering game machines 802 (client) or the wagering game server 806 can provide functionality that is not directly related to game play. For example, account transactions and account rules may be managed centrally (e.g., by the wagering game server 806) or locally (e.g., by the wagering game machine 802). Other functionality not directly related to game play may include power management, presentation of advertising, software or firmware updates, system quality or security checks, etc. In addition, the wagering game server 806 can provide functionality for any one of editing a progressive game skin and dynamically skinning progressive games.

Any of the wagering game network components (e.g., the wagering game machines 802) can include hardware and machine-readable media including instructions for performing the operations described herein.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

indicating a plurality of perceivable elements for a presentation template of a progressive game;

modifying the presentation template in accordance with a set of one or more configurations that at least comprise spatial layout of one or more of the plurality of perceivable elements; and dynamically generating program code that, when invoked, instantiates the modified presentation template on a set of one or more devices in accordance with the set of one or more configurations.

2. The method of claim 1 further comprising determining that a condition for said modifying the presentation template is satisfied, wherein said modifying the presentation template is dependent upon the condition being satisfied, and deploying the modified presentation template and generated program code to the set of one or more devices to replace a currently deployed presentation template that has at least one different perceivable element.

3. The method of claim 1, wherein said indicating the plurality of perceivable elements comprises referential embedding of at least one of the plurality of perceivable elements.

4. The method of claim 1, wherein the set of one or more configurations also comprises one or more of a property of one or more of the perceivable elements, a condition for presentation of one or more of the perceivable elements, and timing for presentation of one or more of the perceivable elements.

5. The method of claim 1, wherein the code comprises one or more of executable program code and interpreted program code.

6. The method of claim 1 further comprising determining that a condition for providing the generated program code and the modified presentation template is satisfied and providing the generated program code and the modified presentation template to a controller device that controls the set of one or more devices for the controller device to execute or interpret the code.

7. The method of claim 6, wherein said determining that the condition for providing the generated program code and the modified presentation template is satisfied comprises at least one of determining that a time condition is satisfied and determining that a license for at least one perceivable element of a currently deployed presentation template has expired or is pending expiration.

8. The method of claim 1 further comprising generating different versions of the presentation template to accommodate different specifications of different ones of the set of one or more devices.

9. The method of claim 1 further comprising validating the set of one or more configurations prior to modifying the presentation template.

10. The method of claim 1, wherein instantiating the presentation template on the set of one or more devices comprises presenting the plurality of perceivable elements in accordance with the set of one or more configurations on the set of one or more devices.

11. A computer program product comprising:

machine executable program instructions encoded in one or more non-transitory machine-readable media, wherein the program instructions that comprise program instructions to:

indicate a plurality of perceivable elements for a presentation template of a progressive game;

modify the presentation template in accordance with a set of one or more configurations that at least comprise spatial layout of one or more of the plurality of perceivable elements; and generate program instructions that, when invoked, instantiate on a set of one or more devices the presentation template as modified in accordance with the set of one or more configurations.

12. The computer program product of claim 11, wherein said program instructions to indicate the plurality of perceivable elements comprises program instructions to referential embed at least one of the plurality of perceivable elements.

13. The computer program product of claim 11, wherein the set of one or more configurations also comprises one or more of a property of one or more of the perceivable elements, a condition for presentation of one or more of the perceivable elements, and timing for presentation of one or more of the perceivable elements.

14. The computer program product of claim 11, wherein the program instructions further comprise program instructions to provide the generated code and the modified presentation template to a controller device that controls the set of one or more devices for the controller device to execute or interpret the code.

15. The computer program product of claim 11, wherein the program instructions to instantiate the modified presentation template on the set of one or more devices comprises program instructions to presenting the plurality of perceivable elements in accordance with the set of one or more configurations on the set of one or more devices.

16. An apparatus comprising:

a set of one or more processor units;

a network interface;

a machine-readable storage medium having program instructions stored thereon, the program instructions executable by the set of one or more processor units to cause the apparatus to, detect satisfaction of a condition for changing a presentation theme of a wagering game, wherein the presentation theme corresponds to at least one of a holiday, a season, a television show, a sponsor, an entertainment character, and a movie promotion; and dynamically modify presentation of the wagering game as presented by one or more devices in response to detection of the satisfaction of the condition for changing the presentation theme of the wagering game, wherein the program instructions executable by the set of one or more processor units to cause the apparatus to dynamically modify presentation of the wagering game comprises program instructions executable by the set of one or more processor units to cause the apparatus to modify a perceivable element of a game skin and generate program instructions for instantiating the game skin in accordance with the presentation theme.

17. The apparatus of claim 16 further comprising program instructions executable by the set of one or more processor units to cause the apparatus to deploy the modified game skin and the generated program instructions to the one or more devices via the network interface.

18. The apparatus of claim 16 further comprising program instructions executable by the set of one or more processor units to cause the apparatus to obtain a set of one or more perceivable elements in accordance with the presentation theme, wherein the set of one or more perceivable elements comprises one or more of a video, audio, an animation sequence, an image, font, and text.

19. An apparatus comprising:

a set of one or more processor units;

a network interface; and a machine-readable storage medium having stored thereon program instructions for a progressive game skin editor, the program instructions executable by the set of one or more processor units to cause the apparatus to, indicate a plurality of perceivable elements for a presentation template of a progressive game;

modify the presentation template in accordance with a set of one or more configurations that at least comprise spatial layout of one or more of the plurality of perceivable elements; and generate program code that, when invoked, instantiates the modified presentation template on a set of one or more devices in accordance with the set of one or more configurations.

20. The apparatus of claim 19, wherein the progressive game skin editor further causes the apparatus to modify the presentation template in accordance with specifications of the set of one or more devices.

21. The apparatus of claim 19, wherein the progressive game skin editor is further operable to cause the apparatus to generate different versions of the presentation template for compatibility with different specifications of different ones of the set of one or more devices.

22. The apparatus of claim 19, wherein the program instructions to cause the apparatus to instantiate the presentation template on the set of one or more devices comprises program instructions to cause the apparatus to present the plurality of perceivable elements in accordance with the set of one or more configurations on the set of one or more devices.

23. The apparatus of claim 19, wherein the progressive game skin editor is-further causes the apparatus to determine status of a progressive game skin deployed on a second set of one or more devices, and operable to configure individual ones of the second set of one or more devices.

* * * * *